US010697274B2

(12) United States Patent
Goodman

(10) Patent No.: US 10,697,274 B2
(45) Date of Patent: Jun. 30, 2020

(54) RESISTOR ACTUATOR RELEASE SYSTEM AND METHODOLOGY

(71) Applicant: Schlumberger Technology Corporation, Sugar Land, TX (US)

(72) Inventor: Kenneth Goodman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 556 days.

(21) Appl. No.: 14/722,924

(22) Filed: May 27, 2015

(65) Prior Publication Data

US 2016/0348474 A1 Dec. 1, 2016

(51) Int. Cl.
*E21B 23/02* (2006.01)
*E21B 41/00* (2006.01)

(52) U.S. Cl.
CPC ..... *E21B 41/00* (2013.01); *E21B 23/02* (2013.01)

(58) Field of Classification Search
CPC ..... E21B 23/02; E21B 41/00
See application file for complete search history.

(56) References Cited

U.S. PATENT DOCUMENTS 3,253,653 A * 5/1966 Layne, Sr. ..... E21B 23/04 102/313
3,419,088 A * 12/1968 Gray ..... E21B 43/119 166/63
3,517,757 A * 6/1970 Hart ..... E21B 43/1185 175/4.55
3,517,758 A * 6/1970 Schuster ..... E21B 43/1185 166/66.4
4,120,519 A * 10/1978 Bridges ..... F42B 15/36 285/3
4,275,786 A * 6/1981 Lee ..... E21B 17/023 166/63
5,819,854 A * 10/1998 Doane ..... E21B 23/00 166/373
6,223,821 B1 * 5/2001 Coronado ..... E21B 33/127 166/122
9,068,411 B2 * 6/2015 O'Connor ..... E21B 23/00

* cited by examiner

*Primary Examiner* — Matthew R Buck
(74) *Attorney, Agent, or Firm* — Cameron R. Sneddon

(57) ABSTRACT

A technique facilitates actuation of a tool via shifting of a first portion with respect to a second portion. A release mechanism initially is engaged between the first portion and the second portion to hold the second portion relative to the first portion in a first operational position. The release mechanism is secured in this initial position by an electrical resistor. By selectively applying sufficient electrical power to the electrical resistor, the electrical resistor disintegrates and allows release of the release mechanism. As a result, the first portion and the second portion may be shifted to a second operational position.

18 Claims, 3 Drawing Sheets

RESISTOR ACTUATOR RELEASE SYSTEM AND METHODOLOGY

BACKGROUND

In many hydrocarbon well applications, a variety of actuators are used to facilitate transition of a well tool between operational positions. In some applications, the well tool may undergo a single actuation to transition the well tool from a first operational configuration to a second operational configuration. For example, one shot valves may be actuated from an initial flow position to a subsequent flow position. A variety of mechanical and/or hydraulic inputs may be delivered downhole to initiate actuation of the well tool.

SUMMARY

In general, a methodology and system are provided which facilitate actuation of a tool by shifting a first portion with respect to a second portion. A release mechanism initially is engaged between the first portion and the second portion to hold the second portion relative to the first portion in a first operational position. The release mechanism is secured in this initial position by an electrical resistor. By selectively applying sufficient electrical power to the electrical resistor, the electrical resistor disintegrates and allows release of the release mechanism. As a result, the first portion and the second portion may be shifted to a second operational position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
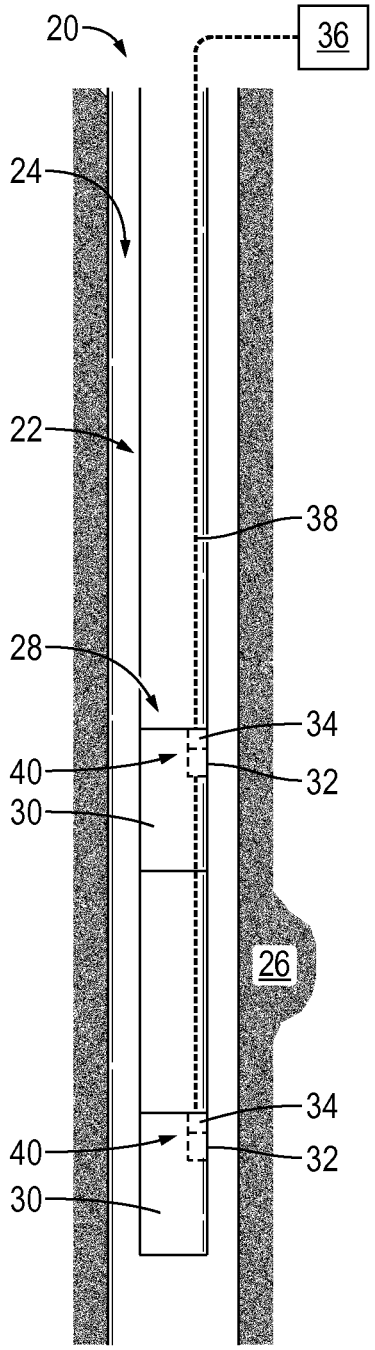
FIG. 1 is a schematic illustration of a well system comprising an example of a plurality of actuatable well tools and corresponding release mechanisms, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate actuation of a tool, such as a well tool located in a wellbore. The technique provides a mechanical release which may be shifted, e.g. released, to enable selective actuation of the tool without physical access to the tool. For example, the release mechanism initially may be engaged between a first portion and a second portion of the well tool. Upon controlled release of the release mechanism, the first portion and a second portion may be shifted between operational positions to thus shift the tool between operational positions.

In this example, the release mechanism is secured in the initial position by an electrical resistor, such as a carbon composition resistor. In some applications, a plurality of the resistors may be used to provide redundancy and/or greater retention power. By selectively applying sufficient electrical power to the electrical resistor, the electrical resistor disintegrates, e.g. burns out, and allows release of the release mechanism. For example, the release mechanism may be spring biased toward a position releasing the first portion from the second portion such that burning out the resistor (or otherwise disintegrating the resistor) allows the release mechanism to transition via the spring bias and to release the first portion and the second portion for relative movement with respect to each other. As a result, the first portion and the second portion may be shifted to a second operational position which, in turn, shifts the tool to a second operational position.

Depending on the application, the release mechanism may be used to initiate dropping of a gun string or other type of tool string; to actuate a valve; to actuate a dump bailer; to set a ball seat; to set a packer; to set a plug; to set an anchor; to place a radio frequency identification tag; or to provide controlled initiation of other types of tool actuation. In some applications, the release mechanism comprises or works in cooperation with suitable electronics which enable addressability of specific release mechanisms. For example, the addressable electronics may be constructed and/or programmed to respond to specific command signals and to provide appropriate outputs to control the release of specific release mechanisms. In this type of embodiment, a plurality of actuatable tools may each have a corresponding release mechanism and the use of addressable electronics enables selection of specific release mechanisms from the plurality of release mechanisms, and thus selection of specific tools, for actuation.

According to an embodiment, the addressable electronics also may be used to provide feedback to a control system, such as a computer-based control system. The electronics may provide feedback on, for example, the status of the release mechanism and/or the integrity of the release mechanism. The control system, or other suitable system, also may comprise a display able to display the status/integrity of the release mechanism. In at least some embodiments, the resistor and the electronics may be mounted on a printed circuit board to facilitate, for example, durability, dependability, and/or ease of construction.

Referring generally to FIG. 1, an embodiment of a well system is illustrated as comprising a plurality of actuatable tools. The actuatable tools comprise or work in cooperation with corresponding release mechanisms which may be controlled without physical access to the actuatable tool. For example, the release mechanisms may be selectively actuated by the application of electric power. The electric power may be provided to the release mechanisms via a power cable or other suitable conductors routed down along the well system. The illustrated well system may comprise many types of components and may be employed in many types of applications and environments, including cased wells and open-hole wells. The well system also may be utilized in vertical wells or deviated wells, e.g. horizontal wells. In some applications, the actuatable tools and corresponding release mechanisms may be used in non-well environments.

Referring again to FIG. 1, a well system 20 is illustrated as comprising a well string 22 deployed in a wellbore 24 drilled into a subterranean formation 26. In some applications, the well string 22 may comprise downhole well equipment 28, such as a completion or bottom hole assembly. The well equipment 28 comprises an actuatable tool 30 or, as illustrated, a plurality of the actuatable tools 30. Each actuatable tool 30 comprises a release mechanism 32 which may be selectively controlled to initiate actuation of the corresponding tool 30 at a desired time.

In some applications, each release mechanism 32 comprises or works in cooperation with electronics 34 which may be selectively controlled via appropriate control signals sent downhole via a control system 36. The electronics 34 and control system 36 are operatively connected via a communication line 38 which may be in the form of a wired or wireless communication line. In some applications, portions of the communication line 38 may be hardwired and portions may be wireless. It should be noted the communication line 38 also may be used to convey signals from electronics 34 uphole to control system 36 so as to enable monitoring of, for example, the status and/or integrity of the corresponding release mechanism 32.

The electronics 34 associated with each actuatable tool 30 also may be constructed to form an addressable switch 40 or other electronics providing for selective actuation. The electronics 34 corresponding with each tool 30 responds to specific signals provided from control system 36 to enable actuation of specific release mechanisms 32 and specific corresponding tools 30. If, for example, the well equipment 28 comprises a plurality of actuatable tools 30 and corresponding release mechanisms 32, the corresponding electronics 34 enable selective actuation of specific release mechanisms 32. Thus, each actuatable tool 30 may be selectively and individually actuated at desired times.

The electronics 34 also may be used to provide feedback with respect to each release mechanism 32 and to display feedback to an operator via a control system display or other data display device. As set forth above, the feedback may comprise information on the status and integrity of each release mechanism however various other types of feedback may be provided according to the parameters of a given application.

Figure 2:
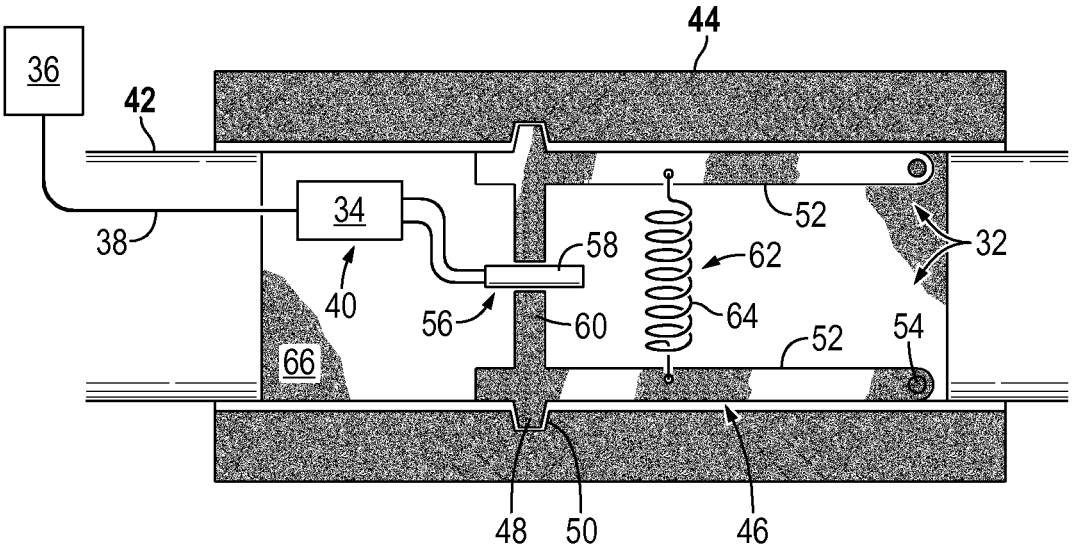
FIG. 2 is a cross-sectional schematic view of an example of a release mechanism coupled with portions which are movable relative to each other, according to an embodiment of the disclosure.

Referring generally to FIG. 2, an embodiment of release mechanism 32 is illustrated. In this example, the release mechanism 32 works in cooperation with a first portion 42, e.g. a slidable member, and a second portion 44, e.g. a housing. The first portion 42 and the second portion 44 are part of or coupled with portions of the corresponding tool 30 such that relative shifting of the first portion 42 with respect to the second portion 44 causes actuation of the corresponding tool 30. In other words, transition of the first portion 42 and second portion 44 from a first operational position to a second operational position causes a corresponding transition of the tool 30 from a first operational position to a second operational position.

In the example illustrated, release mechanism 32 comprises a mechanical release 46 movably mounted to one of the first portion 42 or second portion 44. By way of example, the release mechanism 32 may be pivotably mounted to first portion 42. Although mechanical release 46 may be constructed in a variety of configurations, one embodiment comprises a catch member 48 positioned to releasably engage second portion 44. For example, the catch member 48 may be in the form of an extension or protuberance which extends into a corresponding recess 50 disposed in a wall of second portion 44 when the release mechanism 32 and corresponding tool 30 are in a first operational position.

According to the embodiment illustrated in FIG. 2, the catch member 48 is mounted to a release arm 52 which, in turn, is pivotably mounted to first portion 42 via a pivot 54, e.g. a pivot pin. In some applications, a plurality of the release arms 52 may be pivotably mounted to corresponding pivots 54 for holding catch members 48 in corresponding recesses 50. The catch members 48 are mechanically held in corresponding recesses 50 by a selectively degradable member 56 which is electrically coupled with electronics 34. In the specific example illustrated, the selectively degradable member 56 is in the form of an electrical resistor 58, such as a carbon composition resistor, and electronics 34 are constructed to also function as addressable switch 40. In some applications, appropriate abutment arms 60 may be positioned between catch members 48 and resistor 58. Although a single resistor 58 is illustrated, some embodiments employ two or more resistors 58 to provide, for example, redundancy or added resistance to shifting of catch members 48 from their corresponding recesses 50.

As illustrated, the catch members 48 may be biased toward a release position in which catch members 48 are disengaged from the corresponding recesses 50. Once the catch members 48 are moved out of engagement with corresponding recesses 50, the first portion 42 may be shifted relative to the second portion 44 to actuate the corresponding tool 30. By way of example, the catch members 48 may be biased toward the release position via a spring member 62 which may comprise a single spring or a plurality of springs. In the embodiment illustrated, the spring member 62 comprises a spring 64 placed in tension between release arms 52. The spring member 62 provides sufficient force to pivot the release arms 52 and to thus disengage catch members 48 from corresponding recesses 50 when resistor 58 disintegrates. In some embodiments, the resistor (s) 58 and the electronics 34 may be mounted on a circuit board, such as printed circuit board 66. The printed circuit board 66 may be mounted on first portion 42 or at another suitable location such that the intact resistor 58 is appropriately positioned to hold catch members 48 in the corresponding recesses 50.

In operation, control system 36 is operated to initiate a supply of electrical power to the appropriate degradable member 56, e.g. resistor 58. For example, the control system 36 may be used to supply a control signal to electronics 34 which, in turn, enables flow of sufficient electrical power to the corresponding resistor 58. It should be noted the source of electrical power may be located at the surface, downhole, or both. As further illustrated in FIG. 3, the flow of sufficient electrical power to resistor 58 causes the resistor 58 to degrade, e.g. burnout, as indicated by degraded region 68. Once the resistor 58 is sufficiently degraded, the mechanical release 46 is shifted to a release position via the influence of spring member 62.

Figure 3:
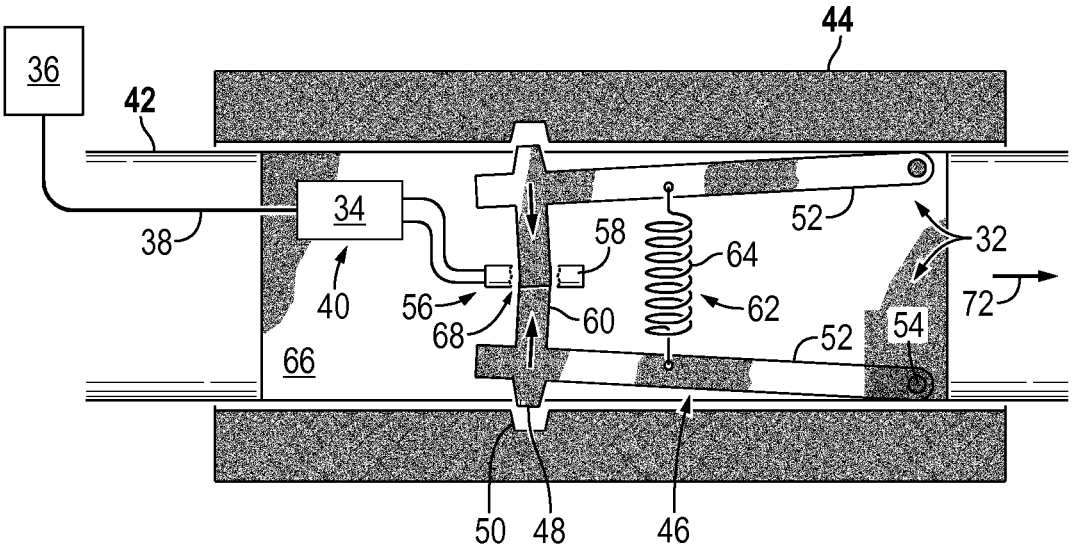
FIG. 3 is a cross-sectional view similar to that of FIG. 2 but showing the release mechanism at a different stage of operation, according to an embodiment of the disclosure.

In the embodiment illustrated in FIG. 3, the degradation of resistor 58 allows spring member 62 to move abutment arms 60 and catch members 48 inwardly in the direction of arrows 70. For example, sufficient room may be provided between the ends of abutment arms 60 or the abutment arms 60 may be positioned to move past each other as release arms 52 are pivoted inwardly via spring member 62. Once the catch members 48 are pulled from corresponding recesses 50, the first portion 42 can be moved relative to the second portion 44 so as to actuate the corresponding tool 30. For example, the first portion 42 may be shifted in the direction of arrow 72 relative to second portion 44.

The relative movement between first portion 42 and second portion 44 may be caused by pressure, spring bias, mechanical actuation, electromechanical actuation, and/or a variety of other mechanisms or techniques which depend on the type of tool 30 and the environment in which tool 30 is operated. If, for example, the relative movement of first portion 42 and second portion 44 is used to shift a valve between operational positions, the relative movement may be caused by a pressure differential between the interior and exterior of well string 22. However, a variety of other mechanisms and techniques may be used to provide the force for causing relative movement of first portion 42 and second portion 44. It also should be noted that mechanical release 46 may utilize many types of catch members 48, including levers, springs, catches, pawls, and/or other suitable mechanisms for selectively holding the release mechanism 32 in a first operational position prior to a controlled release.

Figure 4:
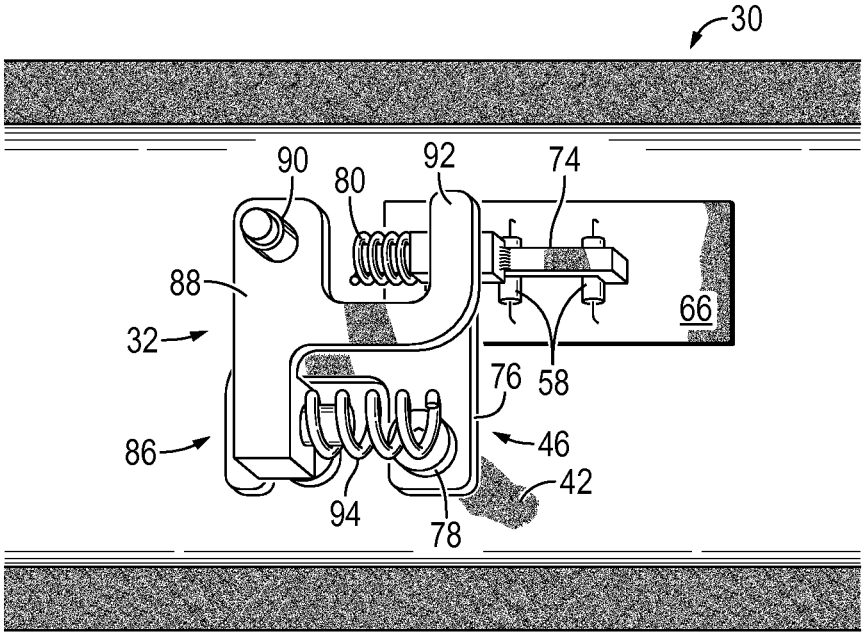
FIG. 4 is an illustration of another example of a release mechanism disposed in an actuatable tool, according to an embodiment of the disclosure.
Figure 5:
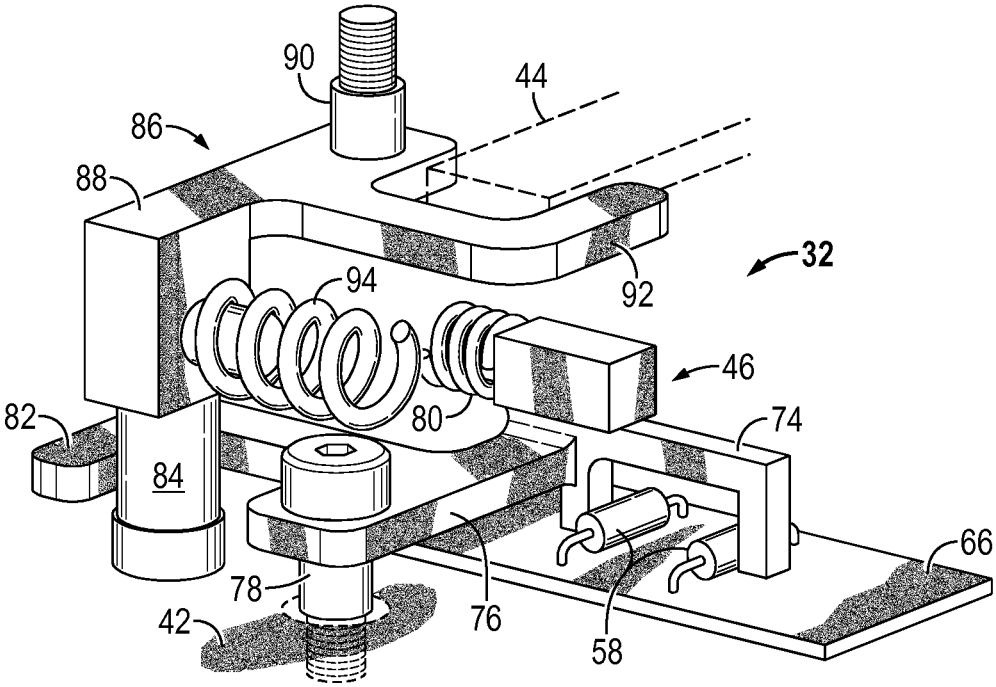
FIG. 5 is an orthogonal view of the release mechanism illustrated in FIG. 4, according to an embodiment of the disclosure.

Referring generally to FIGS. 4 and 5, another embodiment of release mechanism 32 is illustrated. In this embodiment, mechanical release 46 comprises an abutment structure 74 positioned to engage a resistor or a plurality of resistors 58 mounted on printed circuit board 66. As with embodiments previously described, the resistors 58 may be electrically coupled with corresponding electronics 34 which, in turn, may be coupled with control system 36. In this example, the abutment structure 74 is coupled with a release arm 76 which is pivotably mounted to first portion 42 via a pivot 78, such as a pivot pin. The abutment structure 74 and the release arm 76 are biased in a given direction by a spring member 80 such that disintegration of the appropriate resistor or resistors 58 allows spring member 80 to pivot the release arm 76 about pivot 78.

In this embodiment, the mechanical release 46 further comprises a retention arm 82 which extends from release arm 76 and engages an abutment feature 84, e.g. a pin, of a secondary mechanical release 86. The secondary mechanical release 86 comprises a secondary release arm 88 coupled with the abutment feature 84. The secondary release arm 88 also is pivotably engaged with first portion 42 (or with another suitable portion of actuatable tool 30) by a pivot 90, such as a pivot pin. A secondary retention arm 92 also may be connected with secondary release arm 88 and configured to engage, for example, a corresponding feature of second portion 44. In this example, a secondary spring member 94 is positioned to bias the secondary retention arm 92 out of engagement with second portion 44 upon release of abutment feature 84 by retention arm 82. In other words, degradation of the resistor or resistors 58 enables actuation of mechanical release 46 which, in turn, enables actuation of secondary mechanical release 86.

As illustrated in FIGS. 4 and 5, a plurality of mechanical releases may be coupled in series and activated in series upon disintegration of the corresponding resistor or resistors 58. FIGS. 4 and 5 illustrate two mechanical releases but greater numbers of mechanical releases may be connected in series for certain applications. In some applications, each successive mechanical release may utilize a successively higher level of spring bias. In other words, spring member 94 may exert a stronger force than spring member 80. This use of sequential mechanical releases effectively enables the use of greater actuating forces that could otherwise be resisted by the mechanical properties of resistors 58. In some applications, the sequential coupling of mechanical releases may provide potential mechanical advantage for actuating a variety of mechanisms which utilize higher forces of actuation.

Depending on the application, a variety of selectively degradable members 56 may be used to mechanically hold release mechanism 32 at a desired initial operational position. In many applications, single or plural carbon composition resistors 58 may be employed in combination with printed circuit boards to enable controlled release of corresponding mechanical releases. In some applications, each release mechanism 32 may be packaged as an independent module with connectors for coupling to, for example, a bulkhead. Additionally, the carbon composition resistor or other types of selectively degradable members may be made with a variety of features to optimize functionality for a given application. Examples of such features include grooves, holes, stronger leads, and/or other features selected according to the parameters of a given environment and application.

Similarly, the well system 20 or other applicable system may utilize many types of actuatable tools and other well string components. The actuatable tools may comprise a variety of valves, plugs, packers, component releases, slides, and/or other tools. The control system 36 also may comprise a variety of control systems able to communicate with various types of electronics 34. In some applications, the control system 36 may comprise a computer-based control system which can be programmed to automate certain types of operations with respect to the actuatable tools 30. Additionally, the materials, components, and/or configurations of the various actuatable tools, control systems, telemetry systems, and/or other equipment may be adjusted according to the parameters of a given environment and application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string having a well tool actuatable between a first operational position and a second operational position, wherein the well tool is operational at the first or the second operational position, the well tool being initially held in the first operational position by a release mechanism, the release mechanism comprising:

a mechanical release mounted to a first portion of the well tool and having a catch member releasably engaged with a second portion of the well tool, wherein the mechanical release comprises an arm coupled to the catch member, the arm being pivotably mounted to the first portion;

a carbon composition electrical resistor positioned to physically hold the catch member in engagement with the second portion until sufficient electrical power is applied to the carbon composition electrical resistor to disintegrate the carbon composition electrical resistor, thus releasing the catch member from the second portion to enable relative movement between the first portion and the second portion which, in turn, shifts the well tool between the first operational position and the second operational position.

2. The system as recited in claim 1, wherein the carbon composition electrical resistor is mounted on a printed circuit board having electronics forming an addressable switch to enable selective disintegration of the carbon composition electrical resistor.

3. The system as recited in claim 1, wherein the arm is biased via a spring member to disengage the catch member from the second portion.

4. The system as recited in claim 1, wherein the mechanical release comprises a plurality of arms coupled to a plurality of corresponding catch members, each arm being pivotably mounted to the first portion.

5. The system as recited in claim 1, wherein the carbon composition electrical resistor comprises a plurality of carbon composition electrical resistors.

6. The system as recited in claim 1, wherein the mechanical release comprises a plurality of mechanical releases in addition to the first and second portions, which activate in series upon disintegration of the carbon composition electrical resistor, wherein the plurality of mechanical releases utilize spring catch members.

7. The system as recited in claim 6, wherein each successive mechanical release of the plurality of mechanical releases has a stronger spring bias force.

8. The system as recited in claim 2, further comprising a control system coupled with the electronics to determine a status of the release mechanism.

9. A method for actuating a tool, comprising:

positioning a mechanical release to hold a first portion of the tool with respect to a second portion of the tool at a first operational position, wherein positioning comprises locating a catch member on an arm pivotably mounted to the first portion;

securing the mechanical release with an electrical resistor;

coupling the electrical resistor to electronics which enable selective delivery of sufficient electrical power to cause disintegration of the electrical resistor; and biasing the mechanical release to a release position such that disintegration of the electrical resistor causes release of the mechanical release and enables shifting of the first portion relative to the second portion to a second operational position, wherein the tool is operational at the first or the second operational positions.

10. The method as recited in claim 9, wherein positioning further comprises locating the catch member of the mechanical release in a corresponding recess of the second portion.

11. The method as recited in claim 9, wherein securing comprises initially blocking movement of the arm with the electrical resistor.

12. The method as recited in claim 11, wherein biasing comprises biasing the arm with a spring coupled to the arm.

13. The method as recited in claim 9, wherein coupling the electrical resistor comprises mounting a carbon composition resistor on a printed circuit board.

14. The method as recited in claim 13, further comprising coupling the electronics to a control system; and using the control system to monitor actuation of the mechanical release.

15. The method as recited in claim 9, wherein positioning comprises positioning the mechanical release in a well tool; and further comprising deploying the well tool downhole into a wellbore.

16. The method as recited in claim 15, further comprising delivering a control signal downhole to the electronics to initiate disintegration of the electrical resistor and actuation of the mechanical release.

17. A system, comprising:

an actuatable tool actuated by shifting a first portion of the tool with respect to a second portion of the tool; and a release mechanism wherein the release mechanism comprises an arm coupled to a catch member, the arm being pivotably mounted to the first portion, the release mechanism initially engaged between the first portion and the second portion to hold the second portion relative to the first portion in a first operational position, the release mechanism being initially secured by an electrical resistor mounted on a printed circuit board and coupled with electronics forming an addressable switch, the electronics enabling selective application of electrical power to the electrical resistor to burn out the resistor and to release the release mechanism, thus enabling shifting of the first portion relative to the second portion to a second operational position, wherein the tool is operational at the first or the second operational positions.

18. The system as recited in claim 17, wherein the electrical resistor comprises a carbon composition resistor.

* * * * *